US007263302B2

(12) United States Patent
Kim

(10) Patent No.: US 7,263,302 B2
(45) Date of Patent: Aug. 28, 2007

(54) DETECTOR FOR DETECTING ABNORMALITY IN DEVELOPER PASSAGE, IMAGE FORMING DEVICE HAVING THE SAME AND DETECTION METHOD THEREOF

(75) Inventor: Hyou-Jin Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 217 days.

(21) Appl. No.: 11/060,467

(22) Filed: Feb. 18, 2005

(65) Prior Publication Data

US 2006/0018677 A1 Jan. 26, 2006

(30) Foreign Application Priority Data

Jul. 21, 2004 (KR) ..... 10-2004-0056795

(51) Int. Cl.
*G03G 15/20* (2006.01)

(52) U.S. Cl. ..... 399/57; 399/237

(58) Field of Classification Search ..... 399/57, 399/237, 238; 222/71; 347/7
See application file for complete search history.

(56) References Cited

U.S. PATENT DOCUMENTS

| | | | | |
|---|---|---|---|---|
| 5,623,715 | A | 4/1997 | Clark | |
| 2003/0138271 | A1 | 7/2003 | Cho et al. | |
| 2004/0105704 | A1* | 6/2004 | Yamauchi et al. | 399/258 |
| 2005/0129422 | A1 | 6/2005 | Lee | |
| 2006/0067739 | A1* | 3/2006 | Kang et al. | 399/237 |

FOREIGN PATENT DOCUMENTS

| | | |
|---|---|---|
| JP | 08-267786 | 10/1996 |
| KR | 1998-040818 | 8/1998 |
| KR | 168225 | 10/1998 |
| KR | 1999-081052 | 11/1999 |

OTHER PUBLICATIONS

European Search Report; Dated: Oct. 10, 2005; Applicant: Samsung Electronics Co., LTD.; Application No. 05253776.8-2209 PCT.

* cited by examiner

*Primary Examiner*—David M. Gray
*Assistant Examiner*—Ryan Gleitz
(74) *Attorney, Agent, or Firm*—Roylance, Abrams, Berdo & Goodman, L.L.P.

(57) ABSTRACT

A detector for detecting an abnormality in the developer passage includes a sensing unit for detecting a rotational speed of the developer pump, a rotational speed storage for storing rotational speed reference of the developer pump, and a controller for controlling the driving of the developer pump and detecting the abnormality in the developer passage on the basis of a comparison between a rotational speed calculation of the developer pump according to a detection signal from the sensing unit and a rotational speed reference of the developer pump stored in the rotational speed storage. The detector can be advantageously used for detecting a leak and/or a clogging in the developer passage caused by a manufacture/assembly defect, or sediment of the developer sludge, and can inform the user about the abnormal state of the developer passage.

33 Claims, 8 Drawing Sheets

DETECTOR FOR DETECTING ABNORMALITY IN DEVELOPER PASSAGE, IMAGE FORMING DEVICE HAVING THE SAME AND DETECTION METHOD THEREOF

CROSS-REFERENCE TO RELATED APPLICATIONS

This application claims benefit under 35 U.S.C. § 119(a) to an application entitled "Detector for Detecting Abnormality in Developer Passage, Image Forming Device Having the Same and Detection Method Thereof", filed in the Korean Intellectual Property Office on Jul. 21, 2004 and assigned Ser. No. 2004-56795, the entire contents of which are expressly incorporated herein by reference.

BACKGROUND OF THE INVENTION

1. Field of the Invention

The present invention relates in general to an image forming device using liquid developer and control method thereof. More particularly, the present invention relates to a detector for detecting an abnormality in a developer passage between a developer cartridge and a developing device, through or along which a liquid developer from the developer cartridge is supplied and collected, to and from the developing device during a developing process, an image forming device having the same and a detection method thereof.

2. Description of the Related Art

In general, an image forming device using a liquid developer, such as a wet electrophotographic printer, includes a developer supply system for supplying the liquid developer to a developing device for use in an image formation process. There are two types of developer supply systems: a combination type, where a developer cartridge and a developing device are combined in one body, and a split type, where a developer cartridge and a developing device are connected by a connecting tube.

The split-type developer supply system typically employs a developer supply pump and/or a developer recovery pump during the developing process to supply liquid developer from the developer cartridge to the developing device through the connecting tube. The split-type developer supply system then recovers the developer from the developing device to the developer cartridge.

FIG. 1 illustrates a conventional electrophotographic printer 10 based on the split-type developer supply system. The wet electrophotographic printer 10 includes an image forming unit 11, and a developer supply unit 21. The image forming unit 11 includes a photosensitive drum 1, such as an organic photoconductive drum (OPC), a laser scanning unit 33, a charger 6, a discharger 7, a developing device 26, and a cleaning blade 8. These constituents interface with one another to perform the image forming procedure in sequence, including the charging, discharging, exposing, and developing operations, thereby forming a desired image on the photosensitive drum 1.

The developing device 26 includes a developing chamber retaining a liquid developer 48, a developing roller 2 disposed under the photosensitive drum 1, a deposit roller 5 applying an electric force to the liquid developer 48 thereby forming a charged developer layer on the developing roller 2, and a metering roller 3 that regulates the charged developer layer formed on the developing roller 2. The metering roller 3 regulates the charged developer layer formed on the developing roller 2 by means of the deposit roller 5 to a developer layer with a fixed amount of toner or concentration (% solid). The metering roller 3 also supplies the developer layer to a nip between the developing roller 2 and the photosensitive drum 1. The developing device 26 also includes a cleaning roller 4 for cleaning the developing roller 2.

To supply the liquid developer 48 to the developing chamber 27, the developer supply unit 21 is disposed over the developing device 26. The developer supply unit 21 includes a developer cartridge 15 that forms a developer storage chamber, and is provided with a first supply inlet 16 and a first developer outlet 17. The developer supply unit 21 further includes a developer supply pump 18 disposed between the first developer outlet 17 of the developer cartridge 15 and a second developer inlet 13 of a developing chamber 27 through first and second connecting tubes 22, 23, and a recovery pump 19 disposed between the first developer inlet 16 of the developer cartridge 15 and a second developer outlet 14 of a recovery chamber 28 through third and fourth connecting tubes 24, 20.

The developer supply pump 18 and the developer recovery pump 19, respectively, includes a first and a second direct current (DC) motor 14, 16 rotating at predetermined speeds under a first and a second pulse width modulated (PWM) signal PWM1, PWM2, each with a predetermined PWM duty cycle value generated from a controller 29.

Operation of the wet electrophotographic printer 10 in regard to the structure discussed above will now be explained. When a print command is applied, the discharger 7 discharges an electric potential on the surface of the photosensitive drum 1, and an electrostatic latent image, or a charged layer corresponding to a print image, is formed on the photosensitive drum 1 by means of the charger 6 and the laser scanning unit 33. Then, a developer layer with a large amount of toner is adhered onto the electrostatic latent image to form a toner image. The developer layer is formed on the developing roller 2 using the liquid developer 48 in the developing chamber 27 by means of the deposit roller 5 and the metering roller 3.

The developer supply pump 18 is driven by a driving voltage supplied to the first DC motor 14 from a power source (not shown) under control of the first PWM signal PWM1 from the controller 29, and supplies the liquid developer 48 in the developer cartridge 15 to the developing chamber 27. The developer recovery pump 19 is driven by a driving voltage supplied to the second DC motor 16 from the power source under the control of the second PWM signal PWM 2 from the controller 29 and recovers liquid developer 48 in the recovery chamber 28 that has overflowed from the developing chamber 27 to the developer cartridge 15.

Concurrently, the toner image that was developed on the photosensitive drum 1 by means of the developer 26 is transferred onto a sheet of print paper with the assistance of a transfer belt (not shown), and a transfer roller (also not shown). The toner image is fixed onto the sheet of print paper by a fixing roller (not shown) to form a final image.

Inevitably, portions of the liquid developer are not transferred to the transfer belt, but remain on the photosensitive drum 1. This residual developer is recovered to a waste developer reservoir 12 by the cleaning blade 8. The photosensitive drum 1 is ready then to be subject to the above-described procedure again for the formation of the next electrostatic latent image and developing of the desired image thereon, with the aid of the discharger 7, the charger 6, the laser scanning unit 33, and the developing device 26.

After the printer 10 completes the printing process, the developer supply pump 18 rotates in the opposite direction of the operation direction when the print command is first applied. This occurs because the driving voltage that it supplied to the first DC motor 14 from the power source is controlled to the opposite polarity by the first PWM signal PWM1 from the controller 29. As a result, the residual liquid developer 48 in the developing chamber 27 is recovered to the developer cartridge 15, and the printing process is ended.

Structural problem exist, however, in the above-described printer 10. The developer passage in which the liquid developer is supplied and recovered between the developer cartridge 15 and the developing device 26 sometimes leaks or becomes clogged. This condition is often not detected by the printer 10.

In particular, when the developer supply pump 18 and the developer recovery pump 19 operate to supply or recover the liquid developer 48 in the developer cartridge 15 to or from the developing device 26, any or all of the developer passage, the developer supply pump 18 and the developer recovery pump 19, might have a leak. The developer passage consists the first and second developer inlets 16, 13, the first and second developer outlets 17, 14, the first, second, third, and fourth connecting tubes 22, 23, 24, 20, and the space among the first, second, third, and fourth connecting tubes 22, 23, 24, 20. The leak can be caused by a manufacturing and/or assembly defect, as a result of a build-up of sediment of the developer sludge, or the sediment clogging of the liquid developer 48.

When the liquid developer 48 leaks, the peripheral components inside the printer are all contaminated by the liquid developer. In addition, when the liquid developer 48 leaks or the passage thereof is stopped up, the developer supply pump 18 and/or the developer recovery pump 19, each being driven by the first and second DC motors 14, 16 whose rotational speeds vary in accordance with the load of the liquid developer 48, can change the speed of rotation.

Further, if the rotational speed of the developer supply pump 18 and/or the developer recovery pump 19 is changed, the amount of the liquid developer 48 to be supplied into the developing chamber 27 and/or the amount of the liquid developer 48 recovered from the recovery chamber 28 varies from the predetermined amounts. Accordingly, the level of the liquid developer 48 in the developing chamber 27 and/or the recovery chamber 28, particularly in the developing chamber 27, changes. As a result, the concentration of the liquid developer formed on the developing roller 2 by the deposit roller 5 and the metering roller 3 changes, and the final image quality deteriorates.

Moreover, because of the leak in the developer passage or the clogged-up passage, if the developer recovery pump 19 runs at a much lower speed than the developer supply pump 18, or if the developer supply pump 18 runs at a much higher speed than the developer recovery pump 19, the amount of the liquid developer 48 supplied through the developer supply pump 18 is greater than the recovered amount of the liquid developer 48 through the developer recovery pump 19. In such case, the liquid developer 48 overflows the recovery chamber 28, thereby contaminating the surroundings.

Therefore, there is a need to develop a detector for detecting an abnormality, such as leakage or clogging, in the developer passage, through which the liquid developer 48 passes to and from the developing device 26.

SUMMARY OF THE INVENTION

It is, therefore, an object of the present invention to provide a detector for detecting an abnormality in a developer passage between a developer cartridge and a developing device. Liquid developer passes through the developer passage from the developer cartridge the developing device during a developing process, and returns excess unused liquid developer from the developing device to the developer cartridge. It is a further object of the present invention to provide the detector for detecting an abnormality in a developer passage between a developer cartridge and a developing device in an image forming device having the same and detection method thereof.

To achieve the above objects and advantages, there is provided a detector for detecting abnormality in a developer passage for use in an image forming device comprising a developer passage for connecting a developing device and a developer cartridge, and at least one developer pump disposed in the developer passage for supplying and recovering a liquid developer in the developer cartridge to and from the developing device, wherein the detector comprises a sensing unit detecting a rotational speed of the developer pump, a rotational speed storage storing rotational speed references of the developer pump, and a controller controlling the driving of the developer pump, and detecting abnormality in the developer passage, on the basis of a comparison between a rotational speed calculation of the developer pump according to a detection signal from the sensing unit and the rotational speed reference of the developer pump stored in the rotational speed storage.

According to an exemplary embodiment of the present invention, the stored rotational speed reference is a rotational speed obtained through controlling a developer pump-driving motor by a pulse width modulated (PWM) signal with a predetermined PWM duty value in a normal state. The PWM duty value is about 50%, and the rotational speed reference is about in the range of 2250±5% RPM (i.e., from about 2137 to about 2363 RPM).

According to an exemplary embodiment of the present invention, when the rotational speed of the developer pump falls outside of the reference range of about 2250±5% RPM, the controller determines that the developer passage is in an abnormal state, and then stops the operation of the image forming device.

According to an exemplary embodiment of the present invention, the controller calculates a rotational speed of the developer pump according to a detection signal from a sensing unit in at least one driving mode out of first and second driving modes, through which in the first driving mode the developer pump supplies the liquid developer from the developer cartridge to the developing device, and in the second driving mode, the developer pump recovers the liquid developer from the developing device to the developer cartridge.

In the situation in which the developer pump consists of one developer pump, the controller, in the first driving mode, calculates a first rotational speed of the developer pump after a lapse of a first time period (T1), which is an amount of time from an operation start point of the developer pump to a point where the liquid developer passes through the developer pump, and further calculates, in the second driving mode, a second rotational speed of the developer pump before a lapse of a second time period (T2), which is an amount of time from the operation start point of the developer pump to a point where the liquid developer is completely recovered from the developer passage to the developing cartridge.

According to an exemplary embodiment of the present invention, the first and second time periods (T1, T2) are in the range of about 1 to about 2 seconds, and about 10 seconds, respectively.

In the case that the developer pump consists of a developer supply pump, and a developer recovery pump, the controller, in the first driving mode, drives both the developer supply pump and the developer recovery pump, and calculates first rotational speeds of the developer supply pump and the developer recovery pump after a lapse of a third time period (T3), which is an amount of time from an operational starting point of the developer supply pump and the developer recovery pump to a point in which the liquid developer passes through the developer recovery pump, and in the second driving mode, drives only the developer supply pump, and calculates a second rotational speed of the developer supply pump before a lapse of a second time period (T2), which is an amount of time from the operational starting point of the developer supply pump to a point where the liquid developer is completely recovered from the developer passage to the developing cartridge. According to an exemplary embodiment of the present invention, the third and second time periods (T3, T2) are in the range of about 4 to about 5 seconds, and about 10 seconds, respectively.

The detector further according to an exemplary embodiment of the present invention further comprises an alarm unit for informing a user of an abnormal state of the developer passage. In an exemplary embodiment of the present invention, the alarm unit comprises a display for displaying the abnormal state of the developer passage, and/or a speaker for informing a user of the abnormal state of the developer passage through an audible signal.

According to another embodiment of the present invention, an image forming device comprises an image forming unit comprising a developing device for developing an electrostatic latent image by using a liquid developer and forming a desired image, a developer supply unit comprising a developer cartridge for storing the liquid developer, a developer passage that connects the developing device and the developer cartridge, and at least one developer pump disposed in the developer passage for supplying and recovering the liquid developer in the developer cartridge to and from the developing device, and an abnormality detection unit for detecting an abnormal state of the developer passage. The abnormality detection unit according to an exemplary embodiment of the present invention comprises a sensing unit for sensing a rotational speed of the developer pump, a rotational speed storage for storing a rotational speed reference of the developer pump, and a controller for controlling the driving of the developer pump, and for detecting the abnormality in the developer passage, on the basis of a comparison between a rotational speed calculation of the developer pump according to a detection signal from the sensing unit and the rotational speed reference of the developer pump stored in the rotational speed storage.

In the above exemplary embodiment of the present invention, the rotational speed reference in the rotational speed storage is a rotational speed obtained through controlling a developer pump-driving motor by a PWM signal with a predetermined PWM duty value in a normal state. According to an exemplary embodiment of the present invention the PWM duty value is about 50%, and the rotational speed reference is in a range of about 2250±5% RPM.

The controller according to an exemplary embodiment of the present invention outputs a PWM signal of about 50% duty value to the developer pump-driving motor to have a control thereon, and when the rotational speed of the developer pump is out of the reference range of about 2250±5% RPM, the controller decides that the developer passage is in an abnormal state, and then stops the operation of the image forming device.

In addition, the controller calculates a rotational speed of the developer pump according to a detection signal from the sensing unit in at least one driving mode out of first and second driving modes, where in the first driving mode the developer pump supplies the liquid developer from the developer cartridge to the developing device, and in the second driving mode the developer pump recovers the liquid developer from the developing device to the developer cartridge.

In the case that the developer pump according to an exemplary embodiment of the present invention consists of one developer pump, the controller, in the first driving mode, calculates a first rotational speed of the developer pump after a lapse of a first time period (T1), which is an amount of time from an operation start point of the developer pump, to a point in which the liquid developer passes through the developer pump, and in the second driving mode, the controller calculates a second rotational speed of the developer pump before a lapse of a second time period (T2), which is an amount of time from the operation start point of the developer pump to a point where the liquid developer is completely recovered from the developer passage to the developing cartridge. Preferably, the first and second time periods (T1, T2) are about 1 to about 2 seconds, and about 10 seconds, respectively.

In the case that the developer pump according to an exemplary embodiment of the present invention comprises a developer supply pump and a developer recovery pump, the controller, in the first driving mode, drives both the developer supply pump and the developer recovery pump, and calculates first rotational speeds of the developer supply pump and the developer recovery pump after a lapse of a third time period (T3), which is an amount of time from operation start points of the developer supply pump and the developer recovery pump to a point where the liquid developer passes through the developer recovery pump, and in the second driving mode, drives only the developer supply pump, and calculates a second rotational speed of the developer supply pump before a lapse of a second time period (T2), which is an amount of time from the operation start point of the developer supply pump to a point where the liquid developer is completely recovered from the developer passage to the developing cartridge. According to an exemplary embodiment of the present invention, the third and second time periods (T3, T2) are from about 4 to about 5 seconds and about 10 seconds, respectively.

An image forming device according to an embodiment of the present invention can further include an alarm unit informing a user or users of an abnormal state of the developer passage. Furthermore, the alarm unit according to an exemplary embodiment of the present invention includes a display for displaying the abnormal state of the developer passage, and/or a speaker informing the user or users of an abnormal state of the developer passage through an audible signal.

Still another embodiment of the present invention provides a method for detecting an abnormality in a developer passage inside an image forming device. The method according to an exemplary embodiment of the present invention comprises driving at least one developer pump disposed in a developer passage connecting a developer cartridge and a developing device, detecting a rotational speed of the developer pump, and detecting an abnormal state of the developer passage, on the basis of a comparison between the detected rotational speed and a rotational speed reference.

The developer pump driving step according to an exemplary embodiment of the present invention comprises driving the developer pump in a first driving mode when a liquid developer in the developer cartridge is supplied to the developing device, and/or driving the developer pump in a second driving mode when the liquid driver is recovered from the developing device to the developer cartridge. The developer pump driving step in the first and/or the second driving mode respectively comprises the step of outputting a PWM signal having about a 50% duty value to a motor for driving the developer pump.

The step of detecting the rotational speed of the developer pump according to an exemplary embodiment of the present invention comprises at least one of detecting a first rotational speed of the developer pump at the step of driving the developer pump in the first driving mode and detecting a second rotational speed of the developer pump at the step of driving the developer pump in the second driving mode.

In the case that the developer pump according to an exemplary embodiment of the present invention comprises a developer pump, the step of detecting the first rotational speed of the developer pump comprises detecting a first rotational speed of a developer pump after a lapse of a first time period (T1), which is an amount of time from an operation start point of the developer pump to a point where the liquid developer passes through the developer pump, and the step of detecting the second rotational speed of the developer pump comprises detecting a second rotational speed of the one developer pump before a lapse of a second time period (T2), which is an amount of time from the operation start point of the developer pump to a point where the liquid developer is completely recovered from the developer passage to the developing cartridge. According to an exemplary embodiment of the present invention, the first and second time periods (T1, T2) are about 1 to about 2 seconds, and about 10 seconds, respectively.

In the case that the developer pump according to an exemplary embodiment of the present invention comprises a developer supply pump and a developer recovery pump, the step of detecting the first rotational speed of the developer pump comprises driving both the developer supply pump and the developer recovery pump and detecting first rotational speeds of the developer supply pump and the developer recovery pump after a lapse of a third time period (T3), which is an amount of time from operation start points of the developer supply pump and the developer recovery pump to a point where the liquid developer passes through the developer recovery pump. The step of detecting the second rotation speed of the developer pump comprises driving only the developer supply pump, and detecting a second rotational speed of the developer supply pump before a lapse of a second time period (T2), which is an amount of time from the operation start point of the developer supply pump to a point where the liquid developer is completely recovered from the developer passage to the developing cartridge. According to an exemplary embodiment of the present invention, the third and second time periods (T3, T2) are about 4 to about 5 seconds and about 10 seconds, respectively.

The step for detecting an abnormal state of the developer passage according to an exemplary embodiment of the present invention comprises comparing at least one of the first and second rotational speeds of the developer pump with the rotational speed reference, and when at least one of the first and second rotational speeds of the developer pump is out of the reference range, deciding that the developer passage is in the abnormal state, and stopping the operation of the image forming device. According to an exemplary embodiment of the present invention, the rotational speed reference is in a range of about 2250±5% RPM. Furthermore, the method for detecting an abnormality in the developer passage according to an exemplary embodiment of the present invention further comprises informing a user or users of the abnormal state of the developer passage. Additionally, the user or users can be informed of the abnormal state of the developer passage by displaying the abnormal state of the developer passage on a display and/or generating an alarm.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
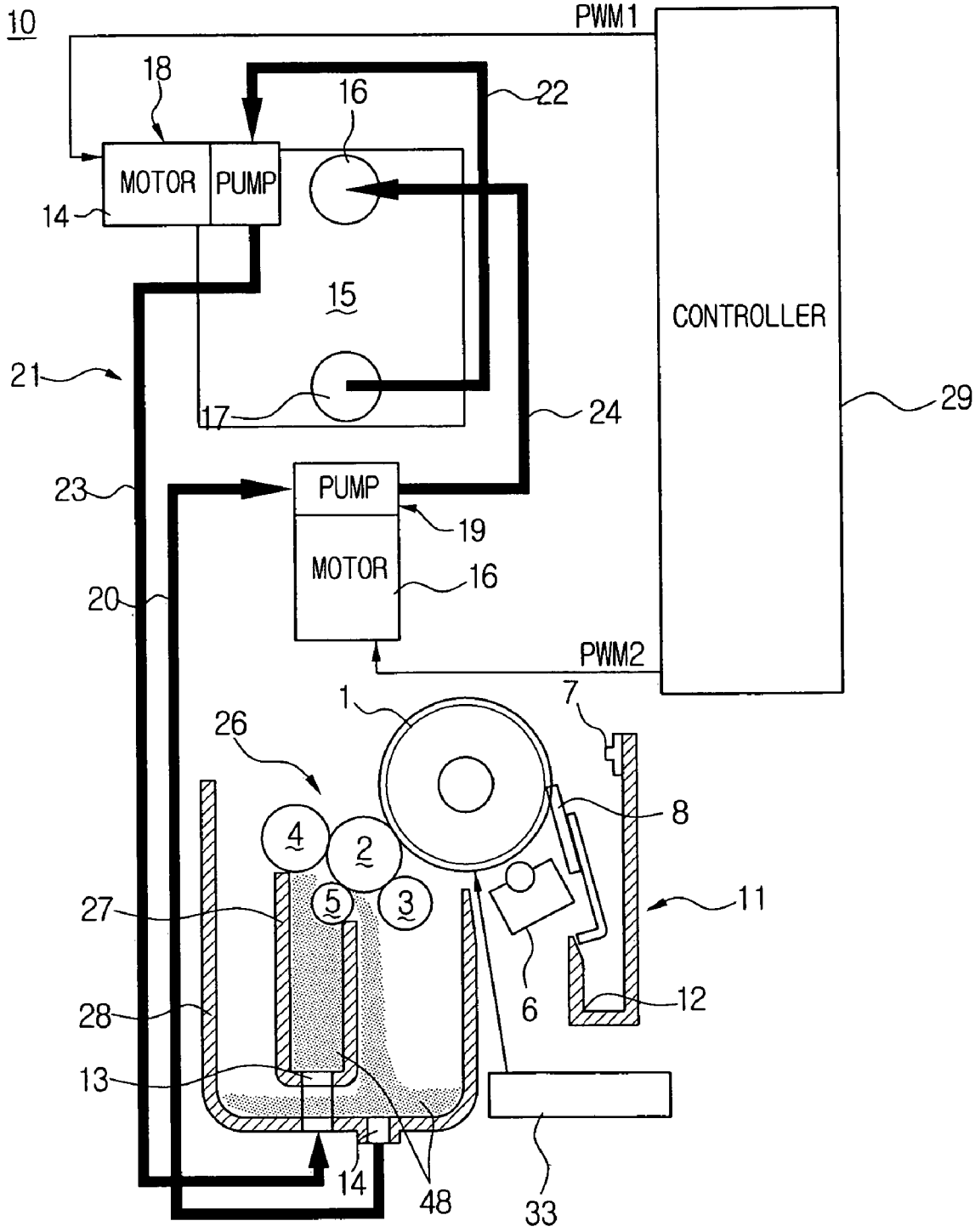
FIG. 1 (PRIOR ART)
FIG. 1 is a schematic diagram illustrating conventional wet electrophotographic printer.

Several exemplary embodiments of the present invention will now be described in detail with reference to the annexed drawings. In the drawings, the same or similar elements are denoted by the same reference numerals throughout the drawings. In the following description, a detailed description of known functions and configurations incorporated herein have been omitted for conciseness and clarity.

Figure 2:
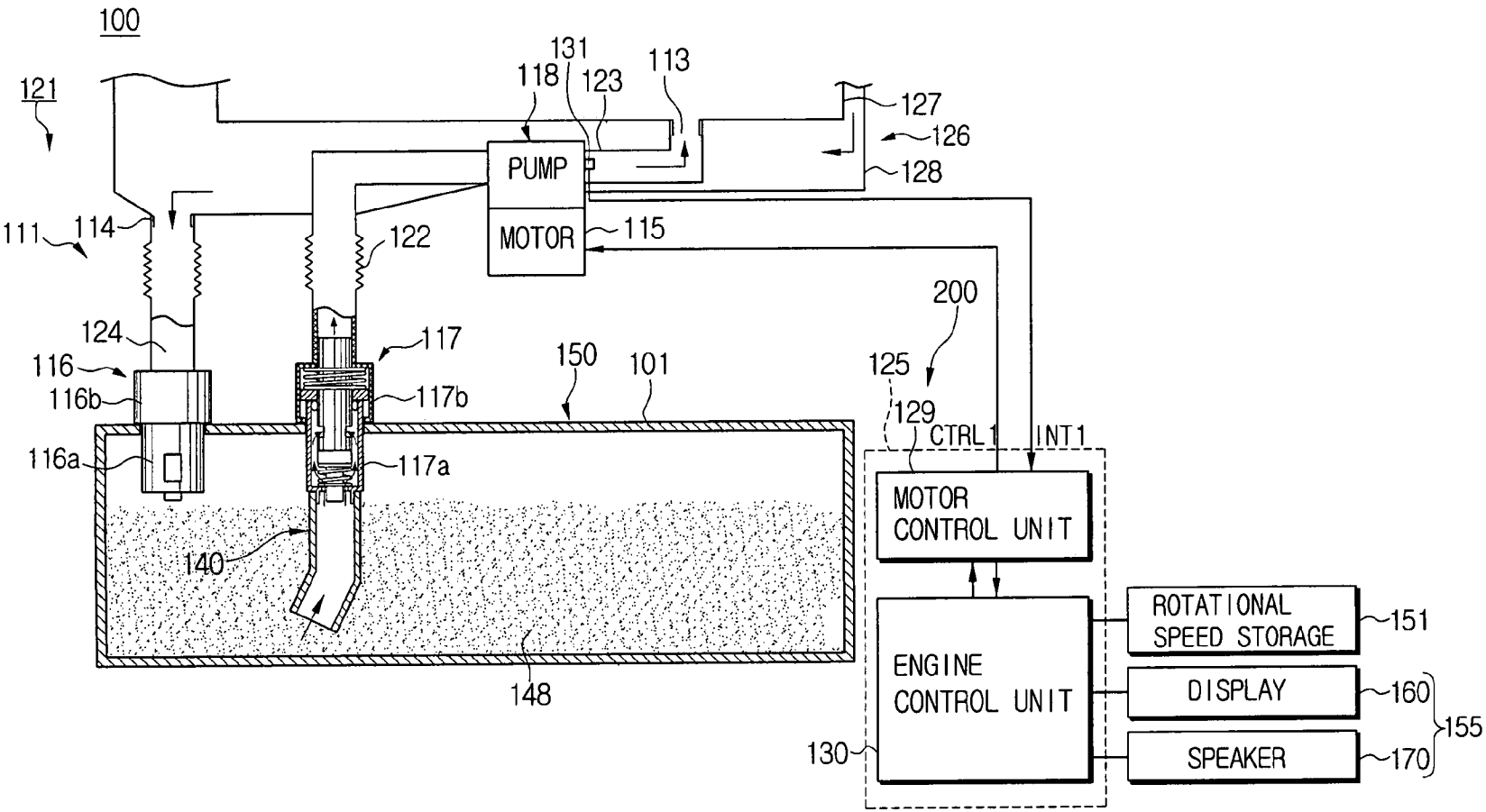
FIG. 2 is a detailed partial schematic view of a wet electrophotographic printer containing a detector for detecting an abnormality in a developer passage according to an embodiment of the present invention.

FIG. 2 illustrates a wet electrophotographic printer 100 containing a detector 200 for detecting an abnormality in a developer passage according to a first embodiment of the present invention. The wet electrophotographic printer 100 includes an image forming unit (not shown) and a developer supply unit 121.

Operation of the image forming unit according to an embodiment of the present invention is similar to those of conventional units, and therefore is well known to those of ordinary skill in the art of the present invention. Thus, a discussion of the operation of the image forming unit according to an embodiment of the present invention has been omitted for the purpose of conciseness. The developer supply unit 121 includes a developer cartridge 150, a developer passage 111, a developer supply pump 118, and a detector 200 for detecting an abnormality in the developer passage 111.

The developer cartridge 150 includes a rectangular-shaped housing 101 as a reservoir of the liquid developer 148, and a stirrer (not shown) for stirring the liquid developer 148 contained in the housing 101. The developer passage 111 consists of a first, a second and a third connecting tube 122, 123, 124.

The first and second connecting tubes 122, 123 connect a first developer output 117 of the developer cartridge 150 and a second developer inlet 113 of a developer chamber 127 inside a developing device 126. Together with the first developer outlet 117 and the second developer inlet 113, the first and second connecting tubes 122 and 123 are used as a part of the developer supply line to supply the liquid developer 48 from the housing 101 to the developing chamber 127, or recover the liquid developer from the developing chamber 127 back to the housing 101 by the developer supply pump 118, which will be described below.

The first developer outlet 117 includes a first female fitting 117*a* installed on an upper portion of the housing 101, and a first male fitting 117*b* installed on one end of the first connecting tube 122 so that the two fittings 117*a*, 117*b* are connected from opposite sides from each other. The first female fitting 117*a* is equipped with a developer suction tube 140 that is extends to the bottom of the housing 101.

The third connecting tube 124 connects a first developer inlet 116 of the developer cartridge 150 and a second developer outlet 114 of a recovery chamber 128 in the developing device 126. Together with the first developer inlet 116 and the second developer outlet 114, the third connecting tube 124 is also used as a part of the developer recovery line to return, to the housing 101, the liquid developer that overflows from the developing chamber 127 in the developing device 126 to the recovery chamber 128.

The first developer inlet 116 includes a second female fitting 116*a* disposed at a designated distance from the first female fitting 117*a* on the upper portion of the housing 101, and a second male fitting 116*b* installed on one end of the third connecting tube 124. The second female and male fittings 116*a*, 116*b* are connected from opposite sides from each other.

The developer supply pump 118 is located between the first and second connecting tubes 122, 123 in the developer passage 111 to be able to supply the liquid developer 148 from the housing 101 to the developing chamber 127, or recover the liquid developer 148 from the developing chamber 127 to the housing 101.

Figure 3A:
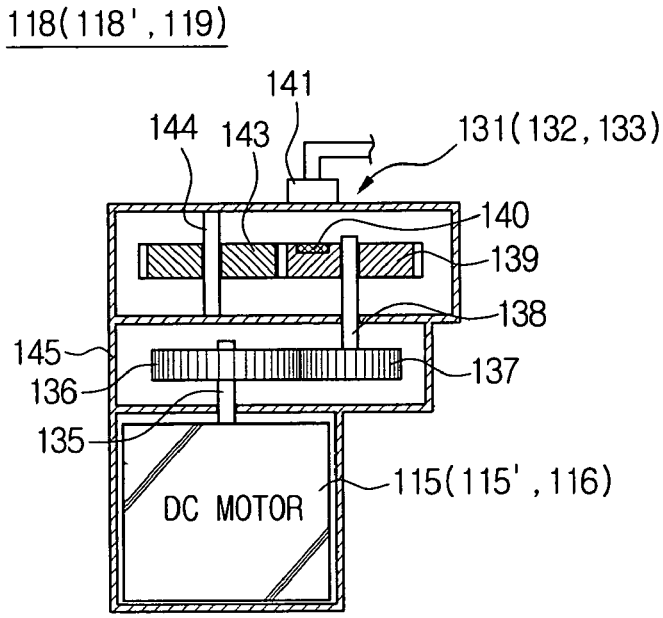
FIGS. 3A and 3B illustrate a vertical cross-sectional view and a horizontal cross-sectional view respectively of a developer supply pump and a sensing unit of the wet electrophotographic printer shown in FIG. 2.
Figure 3B:
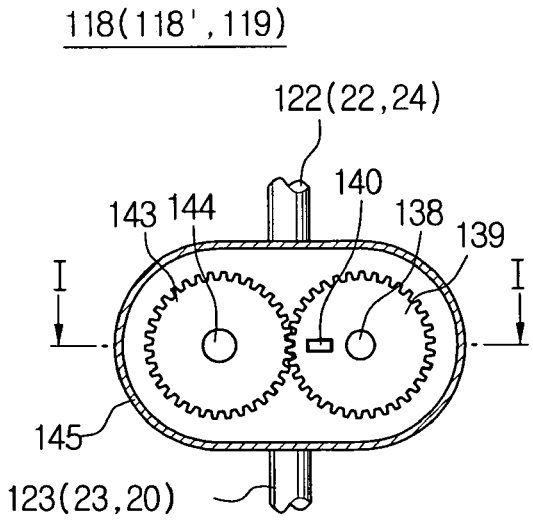

As shown in FIG. 3A and FIG. 3B, the developer supply pump 118 includes a casing 145, a DC motor 115 disposed at a lower portion of the casing 145, a first power transmission gear 136 coupled to a first shaft 135 of the DC motor 115, a second power transmission gear 137 geared with the first power transmission gear 136, a first pump gear 139 coaxially mounted on a second shaft 138 of the second power transmission gear 137, and a second pump gear 143 fixed on a third shaft 144 that is rotatably mounted in the casting 145 so that the first and second pump gears 139, 143 are geared with each other.

When the DC motor 115 rotates in one direction (hereinafter, it will be referred as a 'clockwise direction') or the other direction (hereinafter, it will be referred as 'counterclockwise direction'), the first and second power transmission gears 136, 137, and the first and second pump gears 139, 143 rotate in sequence. This rotation enables the developer supply pump 118 to supply the liquid developer 148 to the developing chamber 127 in the developing device 126, or recover the liquid developer 148 from the developing chamber 127 to the developer cartridge 150.

The detector 200 for detecting an abnormality in the developer passage according to an embodiment of the present invention includes a sensing unit 131, a rotational speed storage 151, and a controller 125. The sensing unit 131 includes a magnet 140 mounted on a top surface of the first pump gear 139 driven by the DC motor 115 of the developer supply pump 118, and a hall sensor 141 installed on the casing 145 to be opposed to the magnet 140. Placed in such a location, the hall sensor 141 can thereby detect the magnetic field from the magnet 140 during the rotation of the first pump gear 139.

Figure 4:
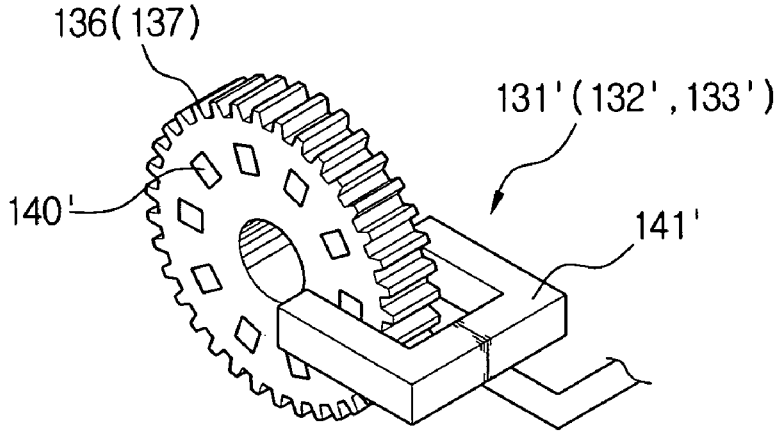
FIG. 4 is a partial perspective view of another embodiment of the present invention of a sensing unit used in the wet electrophotographic printer shown in FIG. 2.
Figure 5A:
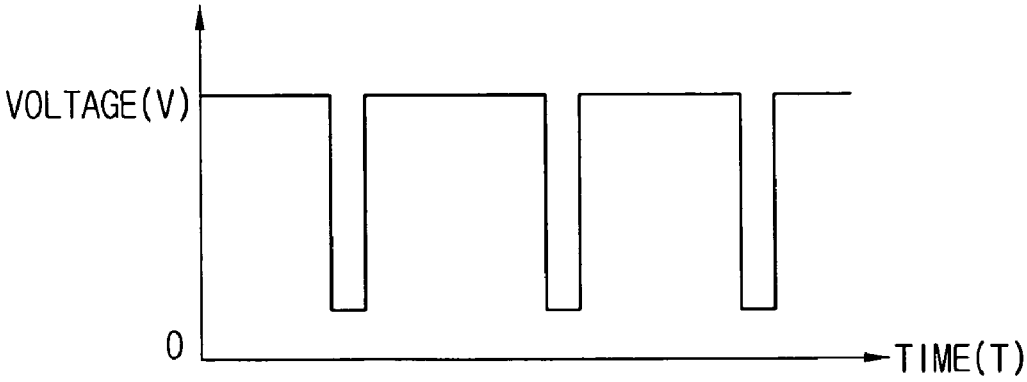
FIGS. 5A and 5B respectively illustrate a detection signal of a sensing unit and a PWM signal controlling a DC motor of a developer supply pump for use in the wet electrophotographic printer shown in FIG. 2.

According to an alternative embodiment of the present invention as shown in FIG. 4, the sensing unit 131' can have a plurality of openings 140' respectively formed in the first power transmission gear 136 fixed to the first shaft 135 of the DC motor 115 of the developer supply pump 118, or in the second power transmission gear 137, and an optical sensor 141' with a light emitting part and a light receiving part fixed to the casing 145 and opposed to the openings 140'.

accordingly, either of the embodiments of the sensing unit 131 or 131' generates a voltage signal, as shown in FIG. 5A, when the magnet 140 passes through the hall sensor 141 or the openings 140' pass through the optical sensor 141'. The sensing unit 131 or 131' generates a detection signal INT1 with a value of '1' (high signal), and outputs the signal to the controller 125.

Figure 5B:
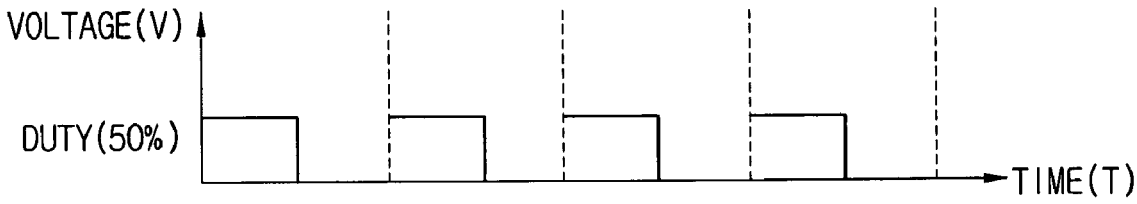
Figure 6:
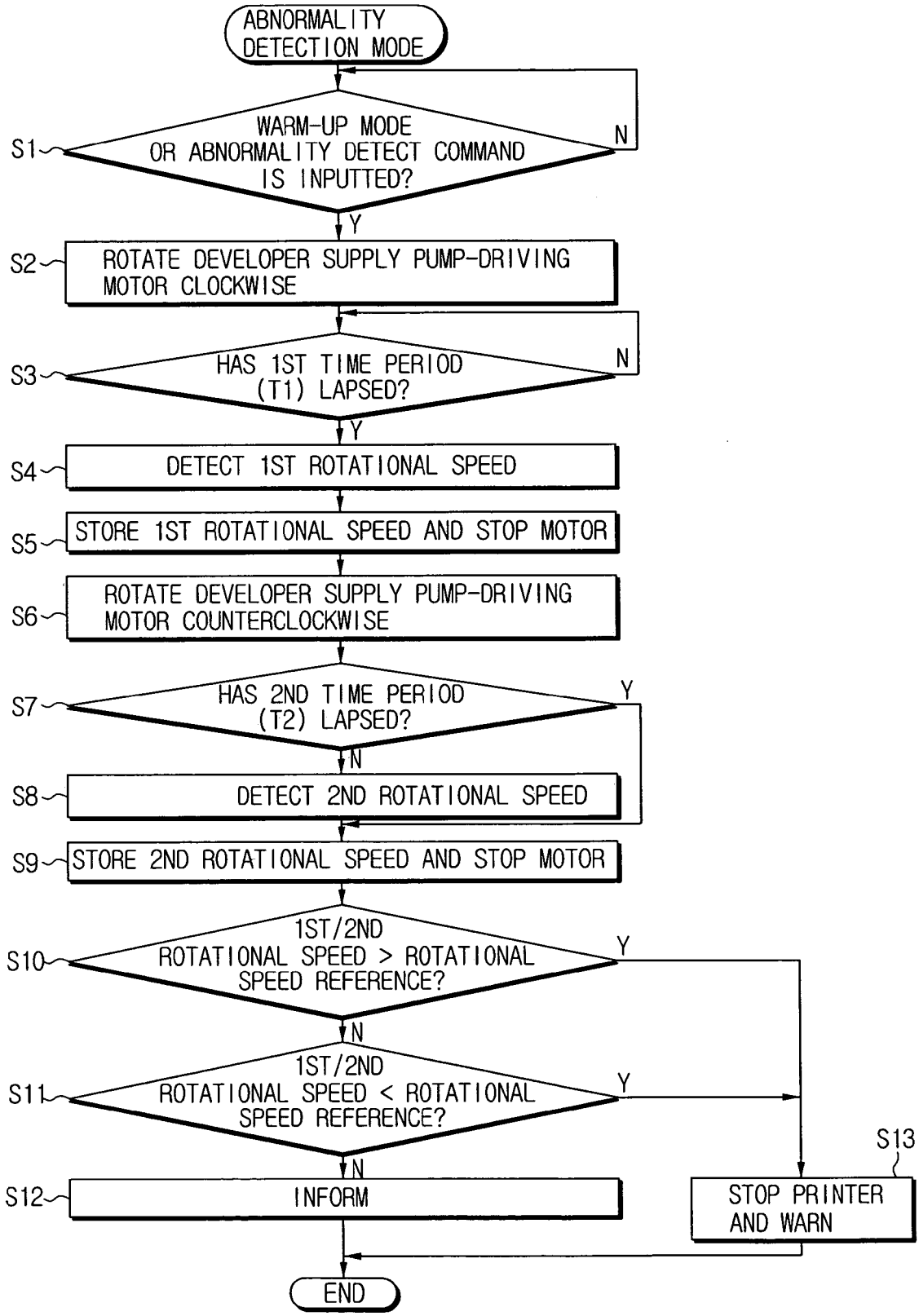
FIG. 6 is a flow chart illustrating a method for detecting abnormality in a developer passage of the wet electrophotographic printer shown in FIG. 2.

The rotational speed storage 151 stores a speed reference of the developer supply pump 118, e.g., about 2250±5% RPM (namely, about 2137 to about 2363 RPM), during its rotations in the clockwise and counterclockwise directions. This rotational speed reference is used as a criterion for the controller 125 to detect the abnormal state of the developer passage 111. The rotational speed reference (about 2250±5% RPM), under the condition that the developer passage 111 is in a normal state, is obtained when a driving voltage supplied from a power source (not shown) to the DC motor 115 is controlled by a PWM signal having about a 50% duty cycle value in order to provide about 50% of the maximum energy, as shown in FIG. 5B.

The controller 125 includes a motor control unit 129 and an engine control unit 130. The motor control unit 129 outputs a detection signal generated by the sensing unit 131 to the engine control unit 130, and controls the driving of the DC motor 115 according to a control signal output from the engine control unit 130.

The engine control unit 130 controls a driving motor (not shown) of the developing device 126 to control the overall operations of the developing device 126, and outputs a control signal CTRL1 necessary to drive the DC motor 115 to the motor control unit 129 for control of the operation of the DC motor 115. Here, examples of the necessary control signals CTRL1 to drive the DC motor 115 include a PWM signal for varying the rotational speed of the DC motor 115, a rotation signal for controlling the rotation of the DC motor 115 in the clockwise and counterclockwise directions, and a motor driving signal for controlling the start and stop modes of the DC motor 115.

The engine control unit 130 drives the DC motor 115 of the developer supply pump 118 in order to carry out a developer supply mode and a developer recovery mode when the printer 100 is turned on and warmed up, or when an abnormality detect command is received from a user through an input unit (not shown), such as a control panel. After turn-on and warm up, the engine control unit 130, based on the detected rotational speed of the developer supply pump 118, can detect an abnormality (such as, leakage and/or clogging) in the developer passage 111.

When either the printer 100 is turned on and warmed up and is heats a fixing roller (not shown) of a fixing device (not shown) to a printing stand-by temperature, or when an abnormality detect command is received through an input unit, the engine control unit 130 outputs a clockwise rotation signal to the motor control unit 129 and rotates the DC motor 115 in the clockwise direction, in order to supply the liquid developer 148 in the housing 101 of the developer cartridge 150 to the developing chamber 127 of the developing device 126. At this time, a PWM signal output from the engine control unit 130 to the motor control unit 129 has about a 50% duty value (FIG. 5B) to ensure that about 50% of the energy is provided.

After the DC motor 115 is driven in the clockwise direction, the engine control unit 130 counts detection signals output from the sensing unit 131, calculates a rotational speed of the developer supply pump 118, or a first rotational speed of the DC motor 115, stores the calculation in the rotational speed storage 151, and stops the DC motor 115. According to an exemplary embodiment of the present invention, the first rotational speed of the DC motor 115 is obtained by counting detection signals output after a lapse of a first time period (T1) from the operation start point of the DC motor 115 to the point where the liquid developer 148 passes through the developer supply pump 118. This occurs, for example, approximately 1-2 seconds after the operation start point. The delay in obtaining the rotational sped of the DC motor 115 is necessary because the developer supply pump 118 pumps only air before the about first time period (T1), so it is impossible to get an accurate rotational speed of the DC motor 115 pumping the liquid developer 148 until after that time.

The engine control unit 130 then outputs a counterclockwise rotation signal to the motor control unit 129 and rotates the DC motor 115 in the counter-clockwise direction, in order to recover the liquid developer 148 from the developing chamber 127 of the developing device 126 to the housing 101 of the developer cartridge 150. At this time, a PWM signal output from the engine control unit 130 to the motor control unit 129 has about a 50% duty cycle value, similar to that of the clockwise rotation.

After the DC motor 115 is driven in the counter-clockwise direction, the engine control unit 130 counts detection signals output from the sensing unit 131, calculates a second rotational speed of the DC motor 115, stores the calculation in the rotational speed storage 151, and stops the DC motor 115. According to an exemplary embodiment of the present invention, the second rotational speed of the DC motor 115 is obtained by counting detection signals output during a second time period (T2) from the operation start point of the DC motor 115 to the point where the liquid developer 148 is completely recovered to the housing 101 of the developer cartridge 150 via the first and second connecting tubes 122, 123 of the developer passage 111. This second time period is, for example, within about 10 seconds. Implementing a second period is necessary because after the second time period (T2), air flows in the developer supply pump 118, so it is impossible to get an accurate rotational speed of the DC motor 115 pumping the liquid developer 148.

The engine control unit 130 compares the first and second rotational speed calculations of the DC motor 115 with the rotational speed reference (i.e., about 2250±5% RPM) stored in the rotational speed storage 151. If either of the first and second rotational speed calculations of the DC motor 115 is out of the reference range, the engine control unit 130 concludes that there is a problem with the developer passage 111 as illustrated in Table 1 below, so it stops operation of the printer 100.

TABLE I

| | RPM | State of developer passage |
|---|---|---|
| 1st and 2nd rotational speeds | 2250 ± 5% | Normal |
| 1st rotational speed | More than 2250 ± 5% | A leak in the 1st connecting tube, or no ink |
| 1st rotational speed | Less than 2250 ± 5% | A clogging in the 2nd connecting tube |
| 2nd rotational speed | More than 2250 ± 5% | A leak in the 2nd connecting tube. |
| 2nd rotational speed | Less than 2250 ± 5% | A clogging in the 1st connecting tube. |

The RPM values listed in TABLE I above are for illustrative purposes. It is to be understood that the RPM values can vary depending on the configuration of the image forming device and the types of components used therein. The RPM values are generally determined via experimentation and use of the image forming device configuration.

The detector 200 for detecting abnormality in the developer passage can further include an alarm unit 155 for alerting a user the abnormal state of the developer passage 111 as described in Table I according to command generated by the engine control unit 130. The alarm unit 155 includes a display 160 for displaying the abnormal state of the developer passage 111, and/or a speaker 170 for alerting the user of the abnormal state of the developer passage 111 through an audible signal.

Accordingly, the detector 200 for detecting an abnormality in the developer passage of the printer 100 according to an embodiment of the present invention has been described to operate in a developer supply mode and a developer recovery mode, rotates the DC motor 115 of the developer supply pump 118 in the clockwise and counter-clockwise directions, and detects the abnormal state, such as leakage and/or clogging, of the developer passage 111 on the basis of the first and second rotational speeds being detected. It is possible, however, to detect an abnormality by operating the DC motor 115 of the developer supply pump 118 in only one mode, e.g., the developer supply mode or the developer recovery mode, and by detecting the first and second rotational speeds of the DC motor 115.

A method will be described below in reference to FIGS. 2 to 6 for detecting an abnormality in the developer passage of the wet electrophotographic printer 100 in which the detector 200 of the present invention is applied. Initially, when the printer 100 is turned on and warmed up, or when the user inputs an abnormality detect command, the engine control unit 130 places itself in an abnormality detect mode (step S1). To make the DC motor 115 supply the liquid developer 148 in the housing 101 of the developer cartridge 150 to the developing chamber 127 of the developing device 126, the engine control unit 130 outputs a clockwise rotation signal and a PWM signal having about a 50% duty cycle value to the motor control unit 129, thereby rotating the DC motor 115 in the clockwise direction (S2).

After driving the DC motor 115 in the clockwise direction, the engine control unit 130 determines whether the first time period (T1) has lapsed. The first time period is the amount of time from the operation start point of the DC motor 115 to the point where the liquid developer 148 passes through the developer supply pump 118, i.e., about 1 to about 2 seconds (decision step S3).

If it turns out that that the first time period T1 has lapsed ("Yes" path from decision step S3), the engine control unit 130 counts the detection signals output from the sensing unit 131, and determines the rotational speed of developer supply pump 118, namely, the first rotational speed of the DC motor 115 (S4). Next, the engine control unit 130 stores the first rotational speed calculation in the rotational speed storage 151, and stops operation of the DC motor 115 (S5).

When the DC motor 115 stops, the engine control unit 130 outputs a counter-clockwise rotation signal and a PWM signal having about a 50% duty cycle value to the motor control unit 129. This rotates the DC motor 115 in the counter-clockwise direction so that the liquid developer 148 in the developing chamber 127 of the developing device 126 can be recovered to the housing 101 of the developer cartridge 150 (S6).

After the DC motor 115 is driven in the counter-clockwise direction, the engine control unit 130 determines whether the second time period (T2) has lapsed. The second time period (T2) is the amount of time from the operation start point of the DC motor 115 to the point where the liquid developer 148 is completely recovered from the first and second connecting tubes 122, 123 of the developer passage 111 to the housing 101 of the developer cartridge 150 (decision step S7).

If it turns out that about 10 seconds have lapsed ("Yes" path from decision step S7), the engine control unit 130 stores the second rotational speed, and stops the DC motor 115 (S9). If 10 seconds have not lapsed ("No" path from decision step S7), the engine control unit 130 counts detection signals output from the sensing unit 131, and calculates the second rotational speed of the DC motor 115 (S8).

As discussed above, the engine control unit 130 then stores the second rotational speed calculation in the rotational speed storage 151, and stops the operation of the DC motor 115 (S9). Afterwards, the engine control unit 130 compares the first and second rotational speed calculations of the DC motor 115 with the rotational speed reference (e.g., about 2250±5% RPM) stored in the rotational speed storage 151 (decision step S10).

If it turns out in step 10 that the first and second rotational speeds are greater than about 2250±5% RPM ("Yes" path from decision step S11), the engine control unit 130 determines that the developer passage 111 is in the abnormal state. Thus, it stops operation of the printer 100 (step S13), and displays on the display 160 the abnormal state as illustrated in Table 1, and at the same time generates an alarm through the speaker 170).

Alternatively, if it turns out in step S10 that the first and second rotational speeds are not greater than about 2250±5% RPM ("No" path from decision step S10), the engine control unit 130 determines whether the first and second rotational speeds are less than 2250±5% RPM (S11). If it turns out in decision step 11 that the first and second rotational speeds are not less than 2250±5% RPM ("No" path from decision step S11), the engine control unit 130 determines that the developer passage 111 is in the normal state. The engine control unit 130 then informs a user through the display 160 and/or the speaker 170 that the printer 100 is in the normal state (S12).

If it turns out in decision step 11 that the first and second rotational speeds are less than about 2250±5% RPM ("Yes" path from decision step S11), the engine control unit 130 decides that the developer passage 111 is in the abnormal state. The engine control unit 130 therefore stops the operation of the printer 100, and displays on the display 160 the abnormal state as illustrated in Table 1, and at the same time generates an alarm through the speaker 170 (S13).

If a user can hear the alarm (i.e., the audible signal) from the speaker 170, and/or can read the message on the display 160, the user is informed of the abnormal state of the developer passage, and can take the necessary measures to resolve the problem.

Figure 7:
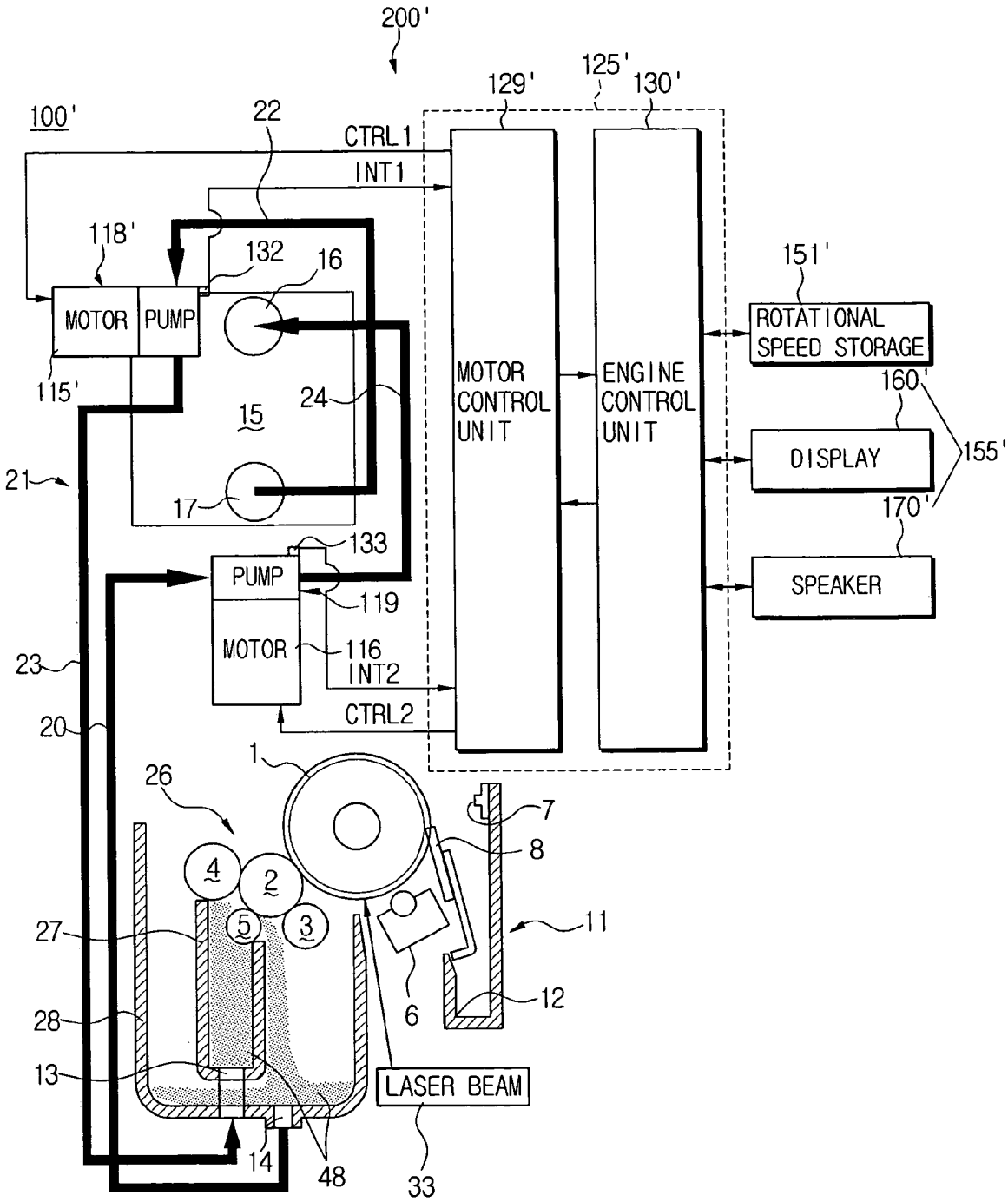
FIG. 7 is a partial cross-sectional view of a wet electrophotographic printer containing a detector for detecting an abnormality in a developer passage according to another embodiment of the present invention.

FIG. 7 illustrates a wet electrophotographic printer 100' which has a detector for detecting abnormality in a developer passage according to a second embodiment of the present invention. The wet electrophotographic printer 100' includes an image forming unit 11, and a developer supply system 21.

Operation of the image forming unit, except for a detector 200' for detecting abnormality in the developer passage as shown in FIG. 7 according to a second embodiment of the present invention, is similar to those of conventional units, and therefore is well known to those of ordinary skill in the art of the present invention. Thus, a discussion of the operation of the image forming unit according to the second embodiment of the present invention has been omitted for conciseness.

The detector 200' for detecting an abnormality in the developer passage according to the second embodiment of the present invention includes first and second sensing units 132, 133; or 132', 133' (please refer to FIGS. 3A, 3B, and 4*b*), a rotational speed storage 151', a controller 125', and an alarm unit 155'.

The first and second sensing units 132, 133; or 132', 133' are installed on a developer supply pump 118' and a developer recovery pump 119, respectively. The constitution and operations of the first and second sensing units 132, 133; or 132', 133' are identical with those of the sensing units described in the first embodiment with reference to FIGS. 3A, 3B, and 4*b*, so further details on them will not be provided here.

The rotational speed storage 151' stores a speed reference of the developer supply pump 118' of its rotations in the clockwise and counter-clockwise directions, and also of the developer recovery pump 119 of its rotation in the clockwise direction. Thus, the rotational speed storage 151' stores the rotational speed references of the first DC motor 115' in the clockwise and counter-clockwise directions, and the second DC motor 116 in the clockwise direction. The speed references are about 2250±5% RPM (about 2137 to about 2363 RPM).

The controller 125' includes a motor control unit 129' and an engine control unit 130'. The motor control unit 129' receives a first and a second voltage detection signal INT1, INT2 generated by the first and second sensing units 132, 133, and outputs them to the engine control unit 130'. The motor control unit 129' controls the driving of the first and second DC motors 114', 116 according to a control signal received from the engine control unit 130'.

The engine control unit 130' controls a driving motor (not shown) of the developing device 26 to control overall operations of the developing device 26, and outputs control signals CTRL1, CTRL2 to the motor control unit 129 for the control over the operation of the first and second DC motors 114', 116, which are necessary to drive the first and second DC motors 114', 116. Control signals necessary to drive the first and second DC motors 114', 116 include a PWM signal for varying the rotational speeds of the first and second DC motors 114', 116, a rotation signal for controlling the rotation of the first and second DC motors 114', 116 in the clockwise and counter-clockwise directions, and a motor driving signal for controlling the start and stop modes of the first and second DC motors 114', 116.

The engine control unit 130' also drives the first and second DC motors 115', 116 of the developer supply and recovery pumps 118', 119 in order to carry out a developer supply mode and a developer recovery mode when the printer 100' is turned on and warmed up, or when an abnormality detect command is received from a user through an input unit (not shown), such as a control panel. Following turn-on and warm-up, the engine control unit 130', can detect an abnormality (such as, leakage and/or clogging) in the developer passage 111, based on the detected rotational speeds.

The engine control unit 130' outputs a clockwise rotation signal to the motor control unit 129' and rotates the first and second DC motors 114', 116 in the clockwise direction when either the printer 100' is turned on and warmed up, a fixing roller (not shown) of a fixing device (not shown) is heated up to a printing stand-by temperature, or an abnormality detect command is received through an input unit. Accordingly, the liquid supply pump 118' supplies the liquid developer 48 of the developer cartridge 15 to the developing chamber 27 of the developing device 26, and the liquid recovery pump 119 recovers the liquid developer 48 from the recovery chamber 28 of the developing device 26 to the developer cartridge 15. PWM signals are generated by the engine control unit 130' and transmitted to the motor control unit 129' and have about a 50% duty cycle value (FIG. 5) to ensure that about 50% of the energy is provided.

After the first and second DC motors 114', 116 are driven in the clockwise directions, the engine control unit 130' counts the first and second rotational speed detection signals output from the first and second sensing units 132, 133, calculates a first rotational speed of the developer supply pump 118' and a first rotational speed of the developer recovery pump 119, (i.e. first rotational speeds of the first and second DC motors 114', 116), stores the calculations in the rotational speed storage 151', and stops the first and second DC motors 114', 116. According to an exemplary embodiment of the present invention, the first rotational speeds of the first and second DC motors 114', 116 are obtained by counting the first and second detection signals output after a lapse of a third time period (T3). The third time period (T3) is measured from the operation start points of the first and second DC motors 114', 116 to the point where the liquid developer 48 passes through the developer supply pump 118', the developing chamber 27 and the recovery chamber 18, and the developer recovery pump 119, for example approximately 4 to 5 seconds from the operation start points of the first and second DC motors 114', 116. The reason the third time period (T3) is this duration is because the developer recovery pump 119 pumps only air before the third time period (T3), so it is impossible to get an accurate rotational speed of the second DC motor 116 pumping the liquid developer 48.

The engine control unit 130' then outputs a counter-clockwise rotation signal to the motor control unit 129' and rotates the first DC motor 115' in the counter-clockwise direction, in order to recover the liquid developer 48 from the developing chamber 27 of the developing device 26 to the developer cartridge 15. A PWM signal is output from the engine control unit 130' to the motor control unit 129' and has about a 50% duty cycle value, similar to that of the clockwise rotation of the first DC motor 115'. The second DC motor 116 does not drive because the liquid developer 48 has already been recovered from the recovery chamber 28 to the developer cartridge 15 in the developer supply mode, and the first rotational speed of the second DC motor 116, which is used as a criterion of the abnormality in the third and fourth connecting tubes 24, 20, has already been detected.

After the first DC motor 115' is driven in the counter-clockwise direction, the engine control unit 130' counts the first detection signals output from the first sensing unit 132, calculates a second rotational speed of the first DC motor 115', stores the calculation in the rotational speed storage 151', and stops the first DC motor 115'. According to an exemplary embodiment of the present invention, the second rotational speed of the first DC motor 115' is obtained by counting detection signals output during a second time period (T2) from the operation start point of the first DC motor 115' to the point where the liquid developer 48 is completely recovered to the developer cartridge 15 via the first and second connecting tubes 22, 23, for example, the second time period (T2) is about 10 seconds.

The engine control unit 130' compares the first and second rotational speed calculations of the first DC motor 115' and the first rotational speed of the second DC motor 116 with the rotational speed references (i.e., about 2250±5% RPM) stored in the rotational speed storage 151'. If any one of them is out of the reference range, the engine control unit 130' concludes that there is a problem with the developer passage 111 as illustrated in Table II below, and stops operation of the printer 100'.

TABLE II

| | | RPM | State of developer passage |
|---|---|---|---|
| 1st DC motor of developer supply pump | 1st and 2nd rotational speeds | 2250 ± 5% | Normal |
| | 1st rotational speed | More than 2250 ± 5% | A leak in the 1st connecting tube or, no ink |
| | 1st rotational speed | Less than 2250 ± 5% | A clogging in the 2nd connecting tube |

TABLE II-continued

| | | RPM | State of developer passage |
|---|---|---|---|
| | 2nd rotational speed | More than 2250 ± 5% | A leak in the 2nd connecting tube |
| | 2nd rotational speed | Less than 2250 ± 5% | A clogging in the 1st connecting tube |
| 2nd DC motor of developer recovery pump | 1st rotational speed | 2250 ± 5% | Normal |
| | 1st rotational speed | More than 2250 ± 5% | A leak in the 3rd connecting tube |
| | 1st rotational speed | Less than 2250 ± 5% | A clogging in the 4th connecting tube |

The RPM values listed in TABLE II above are for illustrative purposes. It is to be understood that the RPM values can vary depending on the configuration of the image forming device and the types of components used therein. The RPM values are generally determined via experimentation and use of the image forming device configuration.

As seen in the detector 200 for detecting abnormality in the developer passage according to the exemplary embodiment of the present invention, the alarm unit 155' includes a display 160' for displaying the abnormal state of the developer passage illustrated in Table II according to the command of the engine control unit 130', and/or a speaker 170' for informing a user of users of the abnormal state of the developer passage 111 through an audible signal.

Figure 8:
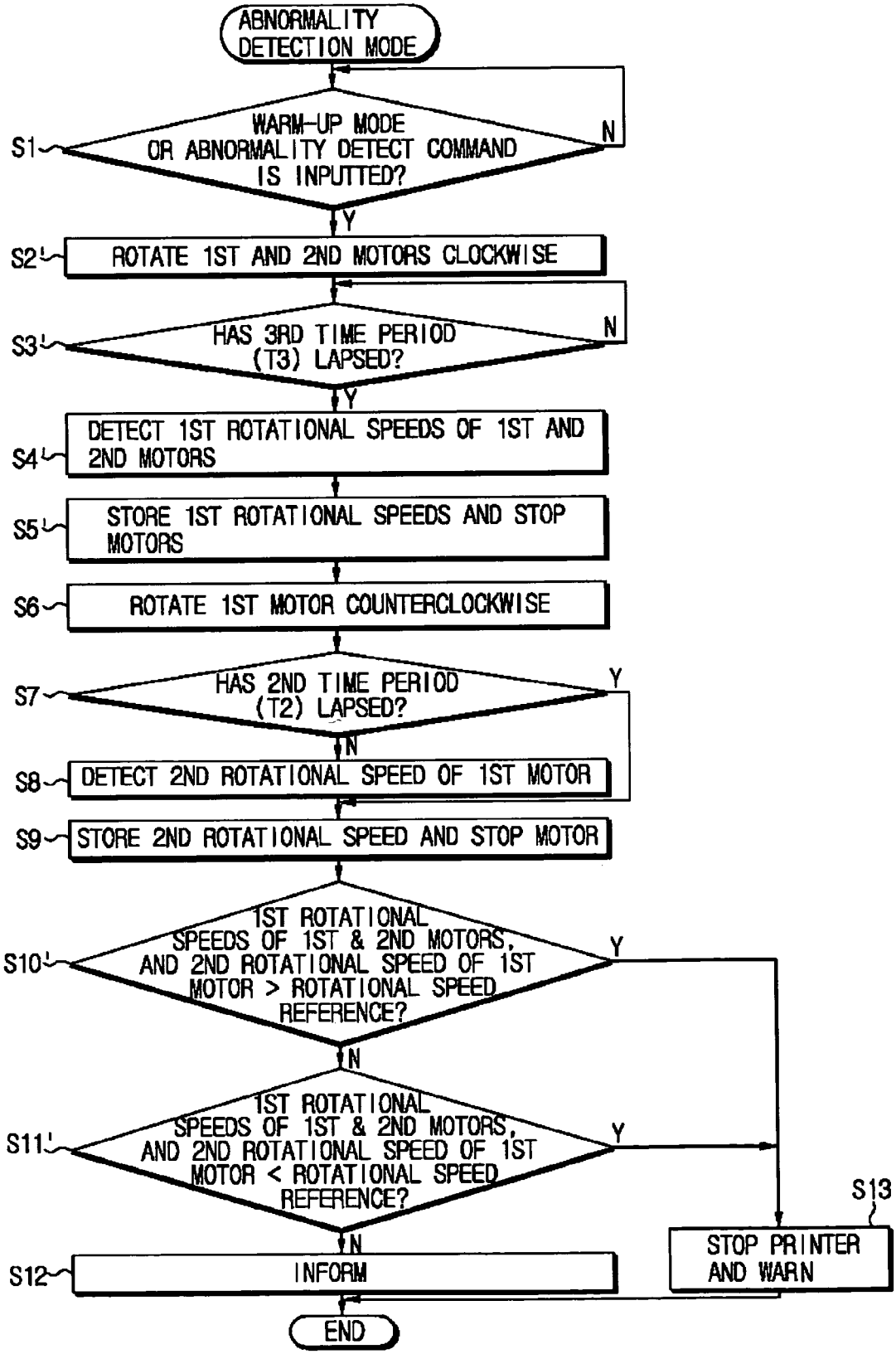
FIG. 8 is a flow chart illustrating a method for detecting an abnormality in a developer passage of the wet electrophotographic printer shown in FIG. 7.

The method for detecting an abnormal state of the developer passage of the printer 100' which the abnormality detector 200' according to the second embodiment of the present invention is applied is substantially similar to the method described in the first embodiment of the present invention. There is a slight difference in that in steps S2' to S5' (please refer to FIG. 8), the first and second DC motors 114', 116 are rotated in the clockwise direction, and after a lapse of the third time period (T3), the first rotational speeds of the first and second DC motors 114', 116 are detected and stored, and in steps S10' and S11', the first and second rotational speeds of the first DC motor 115' and the first rotational speed of the second DC motor 116 are compared with the rotational speed reference.

The detector for detecting abnormality according to the exemplary embodiments of the present invention in the developer passage, the image forming device having the same, and detection method thereof can be advantageously used for detecting a leak and/or a clogging in the developer passage caused by a manufacture/assembly defect, or sediment of the developer sludge, and can also warn the user about the abnormal state of the developer passage. As a result, it becomes possible to prevent deteriorations in the image quality and contamination of other peripheral components due to the leakage and/or clogging of the liquid developer.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A detector for detecting an abnormality in a developer passage for use in an image forming device having a developer passage for connecting a developing device and a developer cartridge, and at least one developer pump disposed in the developer passage for supplying and recovering a liquid developer in the developer cartridge to and from the developing device, the detector comprising:

a sensing unit for detecting a rotational speed of the developer pump;

a rotational speed storage for storing a rotational speed reference of the developer pump; and a controller for controlling the driving of the developer pump, and detecting the abnormality in the developer passage, on the basis of a comparison between a rotational speed calculation of the developer pump according to a detection signal from the sensing unit and the rotational speed reference of the developer pump stored in the rotational speed storage.

2. The detector according to claim 1, wherein the rotational speed reference stored in the rotational speed storage is a rotational speed obtained through controlling a developer pump-driving motor by a pulse width modulated (PWM) signal with a predetermined PWM duty cycle value in a normal state.

3. The detector according to claim 2, wherein the PWM duty cycle value is about 50%, and the rotational speed reference is in a range of about 2250±5% RPM.

4. The detector according to claim 2, wherein when the rotational speed of the developer pump is out of the reference range of about 2250±5% RPM, the controller determines that the developer passage is in an abnormal state, and then stops the operation of the image forming device.

5. The detector according to claim 1, wherein the controller calculates the rotational speed of the developer pump according to a detection signal transmittal from the sensing unit in at least one driving mode of first and second driving modes, where in the first driving mode, the developer pump supplies the liquid developer from the developer cartridge to the developing device, and in the second driving mode, the developer pump recovers the liquid developer from the developing device to the developer cartridge.

6. The detector according to claim 5, further comprising the developer pump comprising one developer pump; and the controller, in the first driving mode, calculates a first rotational speed of the developer pump after a lapse of a first time period (T1), which is an amount of time from an operation start point of the developer pump to a point where the liquid developer passes through the developer pump, and in the second driving mode, calculates a second rotational speed of the developer pump before a lapse of a second time period (T2), which is an amount of time from the operation start point of the developer pump to a point where the liquid developer is completely recovered from the developer passage to the developing cartridge.

7. The detector according to claim 6, wherein the first and second time periods (T1, T2) are between about 1 to about 2 seconds, and about 10 seconds, respectively.

8. The detector according to claim 5, further comprising:

the developer pump comprising a developer supply pump, and a developer recovery pump; and the controller, in the first driving mode, drives both the developer supply pump and the developer recovery pump and calculates first rotational speeds of the developer supply pump and the developer recovery pump after a lapse of a third time period (T3), which is an amount of time from operation start points of the developer supply pump and the developer recovery pump to a point where the liquid developer passes through the developer recovery pump, and in the second driving mode, drives only the developer supply pump and calculates a second rotational speed of the developer supply pump before a lapse of a second time period (T2), which is an amount of time from the operation start point of the developer supply pump to a point where the liquid developer is completely recovered from the developer passage to the developing cartridge.

9. The detector according to claim 8, wherein the third and second time periods (T3, T2) are between about 4 to about 5 seconds and about 10 seconds, respectively.

10. The detector according to claim 1 further comprising:

an alarm unit informing a user or users of an abnormal state of the developer passage.

11. The detector according to claim 10, wherein the alarm unit comprises: at least one of a display displaying the abnormal state of the developer passage, and a speaker informing the abnormal state of the developer passage through an audible signal.

12. An image forming device, comprising:

an image forming unit comprising a developing device for developing an electrostatic latent image by using a liquid developer and for forming a desired image;

a developer supply unit comprising a developer cartridge for storing the liquid developer, a developer passage connecting the developing device and the developer cartridge, and at least one developer pump disposed in the developer passage for supplying and recovering the liquid developer in the developer cartridge to and from the developing device; and an abnormality detection unit for detecting an abnormal state of the developer passage, wherein the abnormality detection unit comprises:

a sensing unit sensing a rotational speed of the developer pump;

a rotational speed storage storing a rotational speed reference of the developer pump; and a controller controlling the driving of the developer pump, and detecting abnormality in the developer passage, on the basis of a comparison between a rotational speed calculation of the developer pump according to a detection signal from the sensing unit and the rotational speed reference of the developer pump stored in the rotational speed storage.

13. The image forming device according to claim 12, wherein the rotational speed reference stored in the rotational speed storage is a rotational speed obtained through controlling a developer pump-driving motor by a PWM signal with a predetermined PVVM duty cycle value in a normal state.

14. The image forming device according to claim 13, wherein the PWM duty value is about 50%, and the rotational speed reference is in a range of about 2250±5% RPM.

15. The image forming device according to claim 13, wherein when the rotational speed of the developer pump is out of the reference range of 2250±5% RPM, the controller determines that the developer passage is in an abnormal state, and then stops the operation of the image forming device.

16. The image forming device according to claim 12, wherein the controller calculates a rotational speed of the developer pump according to a detection signal from the sensing unit in at least one driving mode out of first and second driving modes, where in the first driving mode, the developer pump supplies the liquid developer from the developer cartridge to the developing device, and in the second driving mode, the developer pump recovers the liquid developer from the developing device to the developer cartridge.

17. The image forming device according to claim 16, further comprising the developer pump comprising one developer pump; and the controller, in the first driving mode, calculates a first rotational speed of the developer pump after a lapse of a first time period (T1), which is an amount of time from an operation start point of the developer pump to a point where the liquid developer passes through the developer pump, and in the second driving mode, calculates a second rotational speed of the developer pump before a lapse of a second time period (T2), which is an amount of time from the operation start point of the developer pump to a point where the liquid developer is completely recovered from the developer passage to the developing cartridge.

18. The image forming device according to claim 17, wherein the first and second time periods (T1, T2) are between about 1 to about 2 seconds, and about 10 seconds, respectively.

19. The image forming device according to claim 16, further comprising the developer pump comprising a developer supply pump, and a developer recovery pump; and the controller, in the first driving mode, drives both the developer supply pump and the developer recovery pump, and calculates first rotational speeds of the developer supply pump and the developer recovery pump after a lapse of a third time period (T3), which is an amount of time from operation start points of the developer supply pump and the developer recovery pump to a point where the liquid developer passes through the developer recovery pump, and in the second driving mode, drives only the developer supply pump and calculates a second rotational speed of the developer supply pump before a lapse of a second time period (T2), which is an amount of time from the operation start point of the developer supply pump to a point where the liquid developer is completely recovered from the developer passage to the developing cartridge.

20. The image forming device according to claim 19, wherein the third and second time periods (T3, T2) are between about 4 to about 5 seconds and about 10 seconds, respectively.

21. The image forming device according to claim 12 further comprising:

an alarm unit informing an abnormal state of the developer passage to outside.

22. The image forming device according to claim 21, the alarm unit comprises at least one of a display displaying the abnormal state of the developer passage, and a speaker informing the abnormal state of the developer passage through an audible signal.

23. A method for detecting abnormality in a developer passage inside an image forming device, the method comprising:

determining a rotational speed reference driving at least one developer pump disposed in a developer passage connecting a developer cartridge and a developing device;

detecting a rotational speed of the developer pump;

detecting an abnormal state of the developer passage, on the basis of a comparison between the detected rotational speed and the rotational speed reference; and informing a user or users of the abnormal state of the developer passage.

24. The method according to claim 23, wherein, the developer pump driving step comprises:

driving the developer pump in at least one of a first driving mode where a liquid developer in the developer cartridge is supplied to the developing device, and a second driving mode where the liquid driver is recovered from the developing device to the developer cartridge.

25. The method according to claim 24, wherein the step of driving the developer pump in at least one of the first and the second driving mode respectively comprises:

outputting a PWM signal having about a 50% duty cycle value to a motor for driving the developer pump.

26. The method according to claim 24, wherein, the step of detecting the rotational speed of the developer pump comprises:

at least one of detecting a first rotational speed of the developer pump at the step of driving the developer pump in the first driving mode or detecting a second rotational speed of the developer pump at the step of driving the developer pump in the second driving mode.

27. The method according to claim 26, wherein the developer pump comprises one developer pump; and the step of detecting the first rotational speed of the developer pump comprises:

detecting a first rotational speed of the one developer pump after a lapse of a first time period (T1), which is an amount of time from an operation start point of the developer pump to a point where the liquid developer passes through the developer pump; and the step of detecting the second rotational speed of the developer pump comprises:

detecting a second rotational speed of the one developer pump before a lapse of a second time period (T2), which is an amount of time from the operation start point of the developer pump to a point where the liquid developer is completely recovered from the developer passage to the developing cartridge.

28. The method according to claim 27, wherein the first and second time periods (T1, T2) are between about 1 to about 2 seconds, and about 10 seconds, respectively.

29. The method according to claim 26, wherein the developer pump comprises:

a developer supply pump and a developer recovery pump; and the step of detecting the first rotational speed of the developer pump comprises:

driving both the developer supply pump and the developer recovery pump; and detecting first rotational speeds of the developer supply pump and the developer recovery pump after a lapse of a third time period (T3), which is an amount of time from operation start points of the developer supply pump and the developer recovery pump to a point where the liquid developer passes through the developer recovery pump; and the step of detecting the second rotational speed of the developer pump comprises:

driving only the developer supply pump; and detecting a second rotational speed of the developer supply pump before a lapse of a second time period (T2), which is an amount of time from the operation start point of the developer supply pump to a point where the liquid developer is completely recovered from the developer passage to the developing cartridge.

30. The method according to claim 29, wherein the third and second time periods (T3, T2) are between about 4 to about 5 seconds and about 10 seconds, respectively.

31. The method according to claim 23, wherein the step of detecting an abnormal state of the developer passage comprises:

comparing at least one of the first and second rotational speeds of the developer pump with the rotational speed reference; and determining that the developer passage is in the abnormal state when at least one of the first and second rotational speeds of the developer pump is out of the reference range, and stopping the operation of the image forming device.

32. The method according to claim 31, wherein the rotational speed reference is in a range of about 2250±5% RPM.

33. The method according to claim 32, wherein the step of informing comprises at least one of:

displaying the abnormal state of the developer passage; and generating an alarm to inform a user or users of the abnormal state of the developer passage.

* * * * *